US005375801A

United States Patent [19]

Porter

[11] Patent Number: 5,375,801

[45] Date of Patent: Dec. 27, 1994

[54] TEMPORARY SIGN POST

[75] Inventor: Steven J. Porter, Roadvale, Australia

[73] Assignee: The South East Queensland Electricity Board, Queensland, Australia

[21] Appl. No.: 979

[22] Filed: Jan. 6, 1993

[30] Foreign Application Priority Data

Feb. 17, 1992 [AU] Australia ..... PL0896

[51] Int. Cl.[5] ..... A45F 3/44

[52] U.S. Cl. ..... 248/156; 40/607; 248/545

[58] Field of Search ..... 248/156, 545, 508, 507; 40/606, 607

[56] References Cited

U.S. PATENT DOCUMENTS

| | | | |
|---|---|---|---|
| 2,967,712 | 1/1961 | Breitenfeldt | 248/156 X |
| 3,143,817 | 8/1964 | Paulson | 40/606 |
| 3,519,234 | 7/1970 | Matson . | |
| 4,120,125 | 10/1978 | Cvetan . | |
| 4,279,104 | 7/1981 | Classen . | |
| 4,483,506 | 11/1984 | Litwiller | 248/545 |
| 4,662,305 | 5/1987 | Cline . | |
| 5,181,335 | 1/1993 | Todd | 40/607 |
| 5,207,402 | 5/1993 | Berry-Tremmel et al. | 248/156 |

FOREIGN PATENT DOCUMENTS

| | | | |
|---|---|---|---|
| 1267932 | 3/1972 | United Kingdom | 40/607 |

*Primary Examiner*—Ramon O. Ramirez

*Attorney, Agent, or Firm*—Fay, Sharpe, Beall, Fagan, Minnich & McKee

[57] ABSTRACT

A post (10) for displaying a sign comprising an elongate support member (12) having a ground penetrating means (14) at one end and a first abutment member (25) adjacent to the ground penetrating means (14). A driving member (28) in the form of a weighted sleeve is mounted on the elongate support member (12) and the driving member may be driven against the first abutment member (25) to drive the elongate support member into the ground. A sign may be hung from a first sign support (32) preferably located on the other end of the elongate support member. A second sign support (35) is provided on the driving member (28). The second sign support (35) may be hooked through a lower portion of the sign in order to provide ballast for the sign.

11 Claims, 1 Drawing Sheet

TEMPORARY SIGN POST

Figure 1:
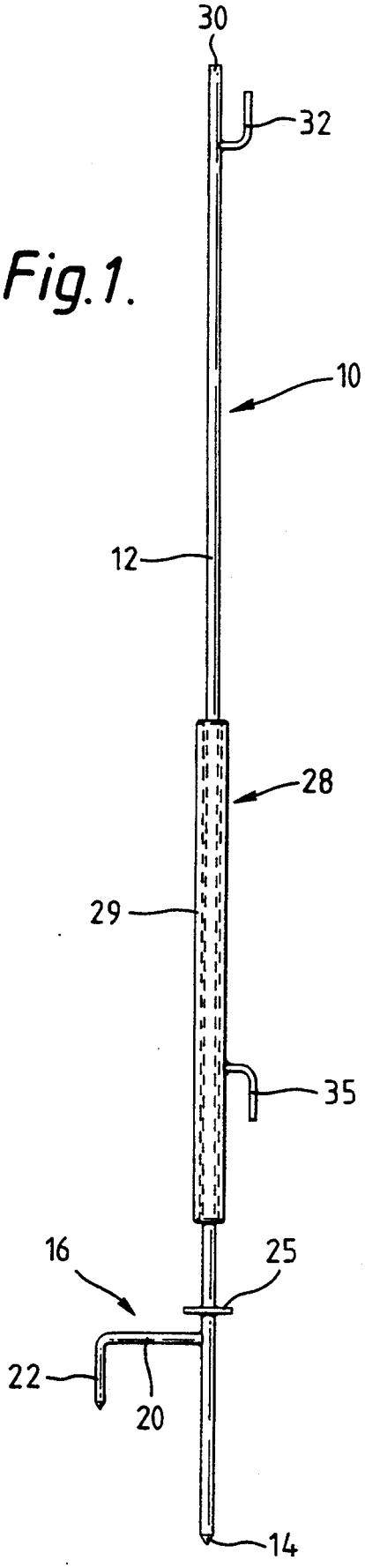

The present invention relates to a post for supporting a sign. In particular, the invention, the invention relates to a temporary sign post having an integral hammer thereby allowing the post to be driven into/out of the ground.

In many areas of public works, such as road construction and repair, temporary signs must be erected to warn motorists of any potential hazards. Generally, the signs are affixed to posts which must be driven into the ground. Therefore it has been found desirable to provide posts which are provided with an integral driver for driving the post into the ground without the use of additional equipment. Such a post is disclosed in U.S. Pat. No. 4,662,305 wherein a weighted sleeve is mounted about an elongate support shaft. Upper and lower collars are provided on the support shaft so that the shaft may be driven into the ground by driving the weighted sleeve against the lower collar. Conversely, the shaft may be removed from the ground by driving the sleeve against the upper collar.

It can be envisage that an important requirement in any temporary sign post would be that of portability. However, the above sign post has a number of disadvantages in that it comprises at least three major subassemblies with a further detachable sub-assembly required in order to display signs which are relatively large or comprised of fabric. The large number of components adds appreciably to the bulk of the sign post, and the subassemblies may become mislaid during storage and/or transportation. Secondly, the detachable sub-assembly is not adapted to suit a variety of sign shapes and sizes. A third disadvantage of the above sign post is that it lacks a means to stabilise it against rotation.

It is an object of the present invention to provide an improved sign post which will at least minimise the above mentioned disadvantages.

In accordance with the present invention there is disclosed a post for displaying a sign comprising:

- an elongate support member having a ground penetrating means at one end thereof;
- a first sign support on the elongate support member;
- a first abutment member on the elongate support member;
- a driving member adapted for sliding movement along the elongate support member between the first abutment member and the other end of the elongate support member wherein in use the driving member may be driven against the first abutment member in order to drive the elongate support member into the ground;
- said driving member being provided with a second sign support such that a sign may be mounted between the first and second sign support members.

As can be appreciated, as the driving member is slidable along the elongate support member and the second sign support moves therewith, the sign post is able to support a range of sizes of signs.

Suitably, the first sign support is located on the elongate support member between the first abutment member and the other end of the elongate support member such that in use the second sign support is lower than the first sign support so that the driving member also provides ballast for the sign or alternatively, if the sign comprises fabric, the weight of driving member holds the sign taut. It is also preferred that the first abutment member is adjacent the ground penetrating means.

The elongate support member may comprise a rod or tube of any suitable cross section. In preference, the support member is a stake of solid circular cross section. The support member may be of any length but suitably, it is of a length such that it may support a sign well above ground level. The support member may also be extendible, for example telescopic, so that the sign may be supported at any desired elevation.

Preferably, the elongate support member is pointed at the one end constituting the ground penetrating means. The ground penetrating means may be barbed to prevent easy removal of the post from the ground. The ground penetrating means may also be provided with vanes to prevent the post from turning in the ground by the action of wind against the sign.

The first and second sign supports may comprise hooks which may be inserted through holes in the sign. Preferably, the hooks are welded to the elongate support member and the driving member where appropriate. Suitably, the hook comprising the first sign support extends towards the other end of the elongate support member (upwardly in use) and the hook comprising the second sign support extends towards the ground penetrating means (downwardly in use). This allows the sign to be held securely between each of the hooks.

The driving member may comprise a weighted sleeve mounted around the elongate support member. Preferably, the internal dimensions of the driving member are slightly larger than external dimensions of the elongate support member allowing the driving member face sliding movement along the elongate support member. Gripping means may also be provided on the driving member to aid the user in lifting the driving member when installing the post in the ground.

The first abutment member may be in the form of a flange extending outwardly from the elongate support member and contactable with by the driving member. It is preferred that the abutment member comprises a collar so that the driving member strikes the abutment member over a maximum possible surface area. The abutment member may be formed integrally with the elongate support member but preferably it is welded thereto.

The post may be further provided with a second abutment member on to the elongate support member near the other end thereof, against which the driving member may be driven in order to aid removal of the post from the ground. The second abutment member may have similar features as described above for the first abutment member.

The post of the present invention may be further provided with at least one stabilising foot in order to maintain the post in an upright position in use. Each foot may comprise a member extending from the elongate support member and is preferably located at a distance along the elongate support member which, in use, would be level with the surface of the ground. The or each foot may be planar or may be in the form of a bar. The or each foot may also be provided with a ground piercing member preventing the elongate support member from turning about its axis.

In use, once a suitable site for the post has been located, the post is held in an upright position with the ground penetrating means located on the ground. While the post is maintained in this position, the user drives the elongate support member into the ground by lifting the driving member and driving/dropping it against the first abutment member. The user may also exert some of his weight on the foot to aid in installation of the post. Once the post is mounted stably in the ground, the top of the sign, barrier or the like is suspended from the first sign support. The driving member is then lifted so that the second sign support may be fastened to a lower portion of the sign. The driving member may then be released and acts as a ballast for the sign or alternatively where the sign is comprised of fabric, the driving member pulls the sign taut. Where a second (upper) abutment member is provided removal of the post from the ground may be facilitated by lifting the driving member and forcing it against the upper abutment member.

Figure 2:
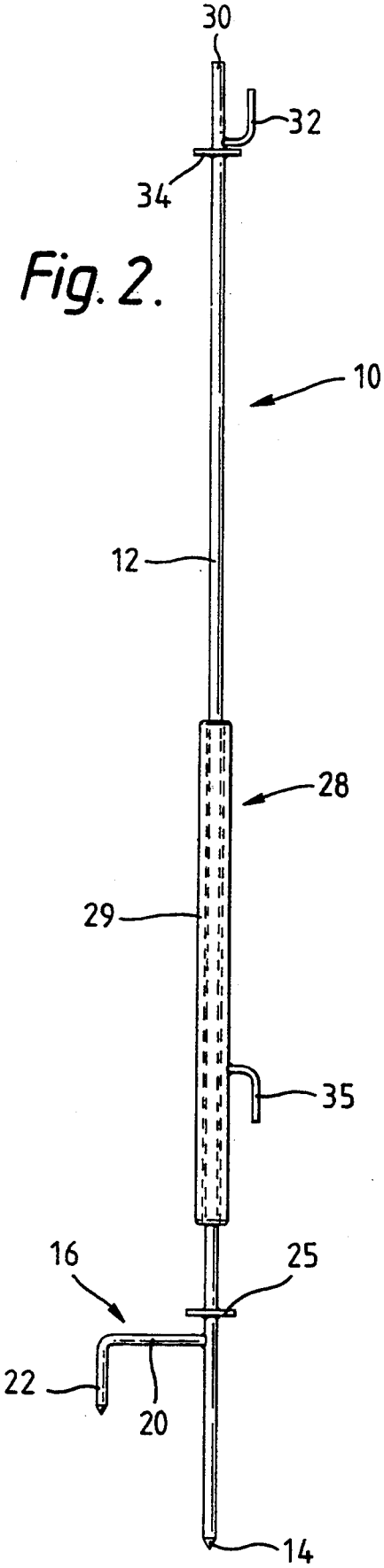

Some embodiments of the present invention will now be described by way of example with reference to the drawings in which FIG. 1 is a side view of the sign post of the first preferred embodiment and FIG. 2 is a side view of the sign post of the second preferred embodiment.

As shown in FIG. 1, the post 10 comprises an elongate rod 12 terminating at a point 14 which facilitates insertion of the rod 12 into the ground (not shown). A foot member 16 extends perpendicularly from the rod 12 at a short distance from the point 14 to stabilise the rod 12 in the ground during use. The foot member 16 comprises a bar 20 extending perpendicularly from the rod 12 and a downwardly projecting spike 22.

A short distance above the foot member 16 a collar 25 of plate metal is welded to the rod 12. A hammer 28 in the form of a tube slidably mounted on the rod 12 is drivable against the collar 25 to drive the rod 12 into the ground.

The upper end 30 of the rod 12 has a first upwardly extending hook 32 from which the upper portion of a sign or banner (not shown) may be suspended. A second downwardly extending hook 35 is located on the hammer 28, the hook 35 being fastenable to a lower portion of the sign, providing a weight on the lower portion of the sign.

The post 10 may be installed in the ground by holding the rod 12 in an upright position whilst the user lifts the hammer 12 and drives it against the collar 25. The user may also exert some of his weight on the foot member 16 to aid in installation. A sign (not shown) may be mounted on the post 10 by hooking a hole or loop member provided on an upper portion of the sign over the first hook 32. The hammer 28 is then lifted and the second hook 35 is inserted through a hole or loop provided in a lower portion of the sign. Upon release of the hammer 28, the weight of the hammer 28 weighs the sign down, or alternatively where the sign comprises fabric, the hammer 28 pulls the sign taut.

FIG. 2 illustrates a second preferred embodiment of the post 33, which is similar in most respects to the embodiment illustrated in FIG. 1 and like numerals represent like features. The post 33 is provided with a collar 34 of plate metal welded to rod 12 adjacent the first upwardly extending hook. In order to remove the post from the ground, the user drives hammer 12 against the collar 34.

The foregoing describes two embodiments of the present invention and modifications obvious to those skilled in the art, can be made thereto by departing from the scope of the present invention.

I claim:

1. A post for displaying a sign comprising:

an elongate support member having a ground penetrating means at one end thereof;

a first sign support integral with and located adjacent to an upper end of the elongate support member;

a first abutment member located adjacent a lower end of the elongate support member;

a driving member adapted for sliding movement along the exterior of the elongate support member between the first abutment member and the first sign support wherein in use the driving member may be driven against the first abutment member in order to drive the elongate support member into the ground;

a second sign support integrally formed with and located adjacent to a lower end of the driving member such that a sign may be mounted between the first and second sign support members; and, a means for tensioning the sign between the first and second sign supports, the means for tensioning comprising a downward force exerted by a weight of the driving member on the second sign support.

2. A post as claimed in claim 1 wherein the first and second sign supports comprise first and second hooks respectively which may be inserted through respective holes through the sign.

3. A post as claimed in claim 2 wherein the first hook extends towards the other end of the elongate support member and the second hook extends towards the ground penetrating means.

4. A post as claimed in claim 1 wherein the driving member comprises a weighted sleeve through which the elongate support member extends.

5. A post as claimed in claim 1 wherein the first abutment member is in the form of a flange extending outwardly from the elongate support member.

6. A post as claimed in claim 1 wherein the first abutment member comprises a collar.

7. A post as claimed in claim 1 further comprising a second abutment member located on the elongate support member near the other end thereof, against which the driving member may be driven in order to aid removal of the post from the ground.

8. A post as claimed in claim 1 further comprising a stabilizing foot secured to said elongate support member in order to maintain the post in an upright position in use.

9. A post as claimed in claim 8 wherein the foot has a ground piercing member which in use prevents rotation of the elongate support member about its longitudinal axis.

10. A post as claimed in claim 8 wherein said stabilizing foot is located adjacent said ground penetrating means of said elongate support member.

11. A post as claimed in claim 8 wherein said stabilizing foot comprises:

a bar extending perpendicular to an axis of said elongate support member; and, a downwardly projecting spike extending normal to an end of said bar, said spike being substantially parallel to said elongate support member.

* * * * *